US011754945B2

(12) United States Patent
Abe

(10) Patent No.: US 11,754,945 B2
(45) Date of Patent: Sep. 12, 2023

(54) TONER STORAGE APPARATUS

(71) Applicant: CANON KABUSHIKI KAISHA, Tokyo (JP)

(72) Inventor: Tsukasa Abe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/581,756

(22) Filed: Jan. 21, 2022

(65) Prior Publication Data

US 2022/0253002 A1 Aug. 11, 2022

(30) Foreign Application Priority Data

Feb. 5, 2021 (JP) ..... 2021-017509

(51) Int. Cl.
*G03G 15/08* (2006.01)

(52) U.S. Cl.
CPC ..... *G03G 15/0881* (2013.01); *G03G 15/0867* (2013.01); *G03G 15/0868* (2013.01); *G03G 15/0877* (2013.01); *G03G 15/0886* (2013.01); *G03G 2215/066* (2013.01)

(58) Field of Classification Search
CPC ..... G03G 15/0886; G03G 15/0867; G03G 15/0877; G03G 15/0881; G03G 2215/066; G03G 2215/0692; B65D 83/06; B65B 37/02
USPC ..... 399/262; 222/160, 162, 542, DIG. 1
See application file for complete search history.

(56) References Cited

U.S. PATENT DOCUMENTS 5,349,427 A * 9/1994 Benedict ..... G03G 21/12 399/102
5,708,952 A * 1/1998 Taniguchi ..... G03G 21/12 399/358
2002/0064401 A1* 5/2002 Ashikari ..... G03G 15/0865 399/258
2009/0087214 A1* 4/2009 Utsunomiya ..... G03G 15/0877 399/103

(Continued)

FOREIGN PATENT DOCUMENTS

JP H02148073 A 6/1990
JP H08110692 A 4/1996
JP 2009069231 A 4/2009

(Continued)

*Primary Examiner* — Robert B Beatty
(74) *Attorney, Agent, or Firm* — Canon U.S.A., Inc. I.P. Division

(57) ABSTRACT

A toner storage apparatus to which a toner cartridge is mountable by being moved in a moving direction includes a toner storage frame that has a reception port and a seal attachment surface, stores toner supplied from the cartridge via the reception port, and has a protrusion from the attachment surface, and a seal portion that is attached to the attachment surface, has a rubbing surface that rubs against the cartridge when the cartridge is moved in the moving direction, and has a communication hole with the reception port. At least part of the protrusion is inside the communication hole and upstream of the reception port in the moving direction. An end of the protrusion is closer to the attachment surface than the rubbing surface in a direction perpendicular to the attachment surface. The seal portion contacts an outer peripheral surface of the protrusion extending in the perpendicular direction.

18 Claims, 11 Drawing Sheets

(56) References Cited

U.S. PATENT DOCUMENTS

| | | | | |
|---|---|---|---|---|
| 2014/0153972 | A1* | 6/2014 | Tsuritani ..... | G03G 15/0886<br>399/262 |
| 2017/0269506 | A1* | 9/2017 | Morita ..... | G03G 15/0898 |

FOREIGN PATENT DOCUMENTS

| | | | |
|---|---|---|---|
| JP | 4562941 | B2 | 10/2010 |
| JP | 2013152361 | A | 8/2013 |
| JP | 2013174817 | A | 9/2013 |

* cited by examiner

TONER STORAGE APPARATUS

BACKGROUND OF THE DISCLOSURE

Field of the Disclosure

The present disclosure relates to a toner storage apparatus used in an electrophotographic image forming apparatus.

Description of the Related Art

There is known an electrophotographic image forming apparatus in which a toner cartridge that stores toner is detachably mounted on a main body of the image forming apparatus in order to replenish toner consumed in image formation.

Japanese Patent Application Laid-Open No. 2009-69231 discusses an image forming apparatus in which a seal member is attached to a reception port provided in a main body of the image forming apparatus and configured to receive toner supplied from a toner cartridge, and the seal member is provided with a communication hole communicating with the reception port.

However, the seal member attached near the reception port of the main body may come into rubbing contact with the toner cartridge (the toner container) and elastically deform in a direction toward the reception port when the toner cartridge is mounted on the main body. In this case, there is an issue where the elastic deformation of the seal member causes the reception port to be closed and results in interfering with the supply of toner from the toner cartridge to the main body.

A possible configuration for preventing the seal member from closing the reception port is that the communication hole of the seal member is made larger than the reception port in consideration of the elastic deformation of the seal member. However, this configuration can cause toner to accumulate in the extra gap, between the communication hole of the seal member and the reception port, by the mounting and removal of the toner cartridge, which may cause toner contamination.

SUMMARY OF THE DISCLOSURE

According to an aspect of the present disclosure, a toner storage apparatus to which a toner cartridge that stores toner and is provided with a supply port for supplying the toner is mountable by being moved in a moving direction includes a toner storage frame provided with a reception port and a seal attachment surface, the toner storage frame being configured to store the toner supplied from the supply port of the toner cartridge via the reception port, the toner storage frame having a protruding portion protruding from the seal attachment surface, and a seal portion attached to the seal attachment surface of the toner storage frame, the seal portion having a rubbing surface configured to come into rubbing contact with the toner cartridge when the toner cartridge is moved in the moving direction, the seal portion being provided with a communication hole communicating with the reception port of the toner storage frame. At least a part of the protruding portion is disposed inside the communication hole of the seal portion and upstream of the reception port in the moving direction. An end of the protruding portion is located closer to the seal attachment surface than the rubbing surface in a direction perpendicular to the seal attachment surface in a state where the toner cartridge is not mounted to the toner storage apparatus. The seal portion is in contact with an outer peripheral surface of the protruding portion that extends in the direction perpendicular to the seal attachment surface.

Further features of the present disclosure will become apparent from the following description of exemplary embodiments with reference to the attached drawings.

DESCRIPTION OF THE EMBODIMENTS

A first exemplary embodiment of the present disclosure will be described with reference to FIGS. 1 to 6.

<Image Forming Apparatus>

Figure 6:
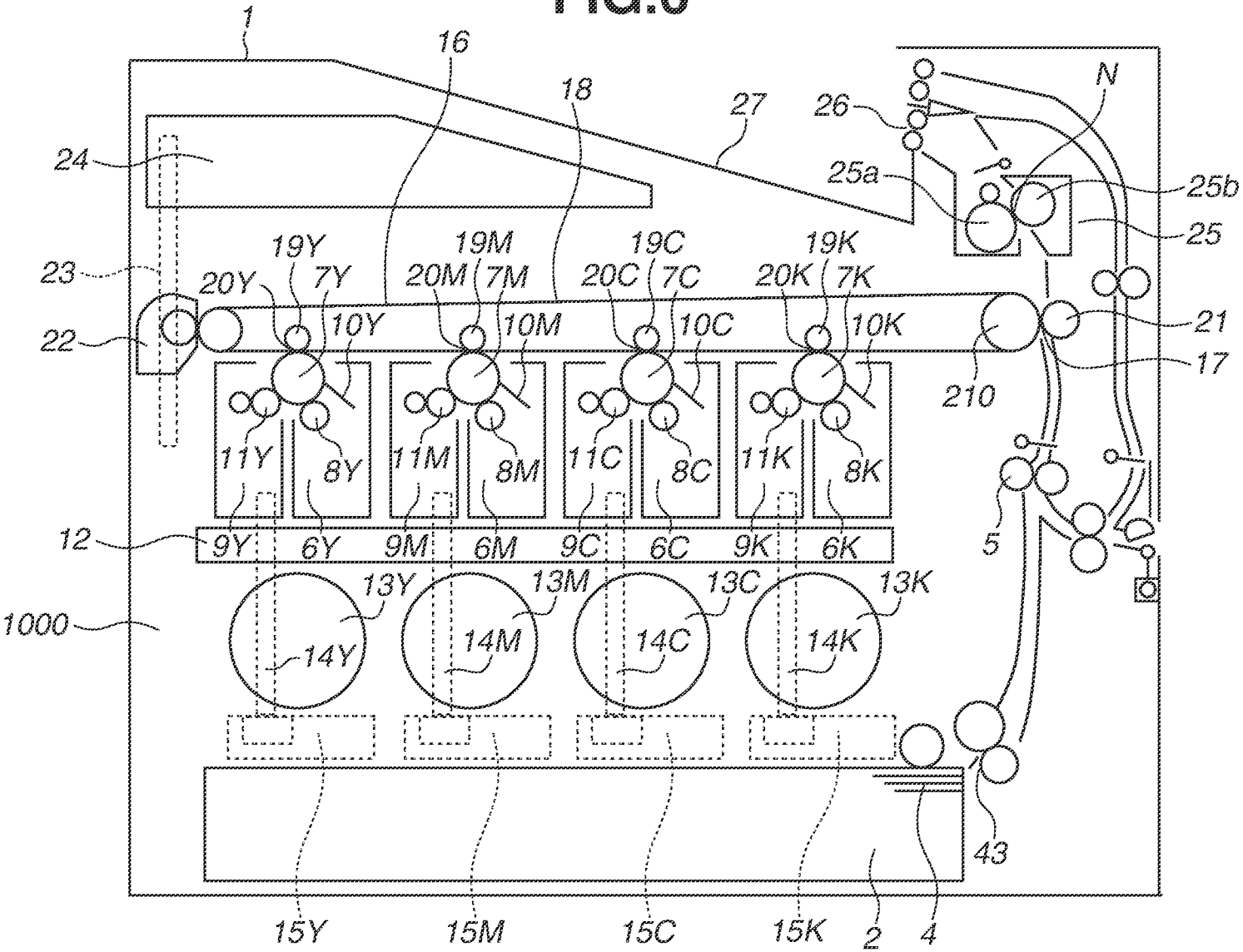
FIG. 6 is a schematic cross-sectional view of an image forming apparatus according to the first exemplary embodiment.

FIG. 6 is a schematic cross-sectional view of an image forming apparatus 1 according to the present exemplary embodiment. Process cartridges 6Y, 6M, 6C, and 6K (hereinafter also referred to as process cartridges 6) function as image forming units for yellow, magenta, cyan, and black, respectively. The process cartridges 6Y, 6M, 6C, and 6K include photosensitive drums 7Y, 7M, 7C, and 7K (hereinafter also referred to as photosensitive drums 7), charging rollers 8Y, 8M, 8C, and 8K, developing devices 9Y, 9M, 9C, and 9K (hereinafter also referred to as developing devices 9), and cleaning blades 10Y, 10M, 10C, and 10K, respectively.

The developing devices 9Y, 9M, 9C, and 9K include developing rollers 11Y, 11M, 11C, and 11K (hereinafter also referred to as developing rollers 11) that are configured to come into contact with and separate from the photosensitive drums 7Y, 7M, 7C, and 7K, respectively. The developing rollers 11 supply toner to the photosensitive drums 7, thereby developing, as toner images, latent images that are formed on the photosensitive drums 7 with laser light emitted from a laser scanner unit 12 based on image information.

The toner images are transferred from the photosensitive drums 7Y, 7M, 7C, 7K to an intermediate transfer belt 18 at primary transfer portions 20Y, 20M, 20C, and 20K (hereinafter also referred to as primary transfer portions 20), respectively. The toner images of the respective colors are sequentially transferred to the intermediate transfer belt 18, so that a toner image of the four colors is formed on a surface of the intermediate transfer belt 18. The toner image of the four colors is then conveyed to a secondary transfer portion 17.

Below the process cartridges 6, toner containers (toner cartridges) 13Y, 13M, 13C, and 13K (hereinafter also referred to as toner containers 13) are provided. The toner containers 13Y, 13M, 13C, and 13K are arranged for the process cartridges 6Y, 6M, 6C, and 6Bk for the four colors, respectively.

An apparatus main body 1000 is a part of the image forming apparatus 1 not including the process cartridges 6 and the toner containers 13, and includes toner conveyance apparatuses 14Y, 14M, 14C, and 14K (hereinafter also referred to toner conveyance apparatuses 14). The toner conveyance apparatuses 14 convey toner from the toner containers 13 to the process cartridges 6. The toner conveyance apparatuses 14Y, 14M, 14C, and 14K are driven by toner conveyance driving devices 15Y, 15M, 15C, and 15K disposed below the toner conveyance apparatuses 14Y, 14M, 14C, and 14K, respectively.

Meanwhile, in a lower portion of the image forming apparatus 1, recording materials 4 are stored in a cassette 2. A cassette sheet feeding roller pair 43 is disposed near front end portions of the recording materials 4, and is configured to rotate to separate the recording materials 4 one by one and convey the recording material 4 toward registration rollers 5. The recording material 4 is then conveyed to a downstream side in a conveyance direction of the recording material 4 by the registration rollers 5.

Above the developing devices 9, an intermediate transfer unit 16 is provided. The intermediate transfer unit 16 includes the intermediate transfer belt 18 opposing each of the photosensitive drums 7. The intermediate transfer belt 18 is a rotatable endless belt and is stretched by a plurality of stretching rollers. On an inner surface of the intermediate transfer belt 18, primary transfer rollers 19Y, 19M, 19C, and 19K (hereinafter also referred to as primary transfer rollers 19) are disposed as primary transfer members and form the primary transfer portions 20 with the photosensitive drums 7 via the intermediate transfer belt 18. At the primary transfer portions 20, the primary transfer rollers 19 to which a voltage is applied transfer the toner images from the photosensitive drums 7 to the intermediate transfer belt 18. In the present exemplary embodiment, a configuration is employed in which a unit including the intermediate transfer belt 18, the plurality of stretching rollers that stretches the intermediate transfer belt 18, and the primary transfer rollers 19 serves as the intermediate transfer unit 16 and is detachably attached to a frame of the apparatus main body 1000. The intermediate transfer unit 16 is disposed approximately horizontally so that the primary transfer portions 20 are directed downward.

A secondary transfer roller 21 as a secondary transfer member is in contact with the intermediate transfer belt 18 and forms the secondary transfer portion 17 with an opposed roller 210 opposed to the secondary transfer roller 21 via the intermediate transfer belt 18. At the secondary transfer portion 17, the toner image transferred to the intermediate transfer belt 18 is secondarily transferred to the recording material 4. Toner that has not been transferred to the recording material 4 in the secondary transfer and remains on the intermediate transfer belt 18 is removed by a cleaning unit 22. The toner removed by the cleaning unit 22 is conveyed to a toner collection container 24 via a toner conveyance unit 23 and accumulated in the toner collection container 24.

The recording material 4 to which the unfixed toner image has been transferred is pressurized and heated at a fixing nip portion N formed by a heating unit 25*a* and a pressure roller 25*b* of a fixing device 25, so that the toner image is fixed to the recording material 4. The recording material 4 is then conveyed to a discharge roller pair 26 and discharged to a sheet discharge tray 27. With this series of operations, an image is formed on the front side of the recording material 4.

<Toner Conveyance Apparatus>

Figure 1:
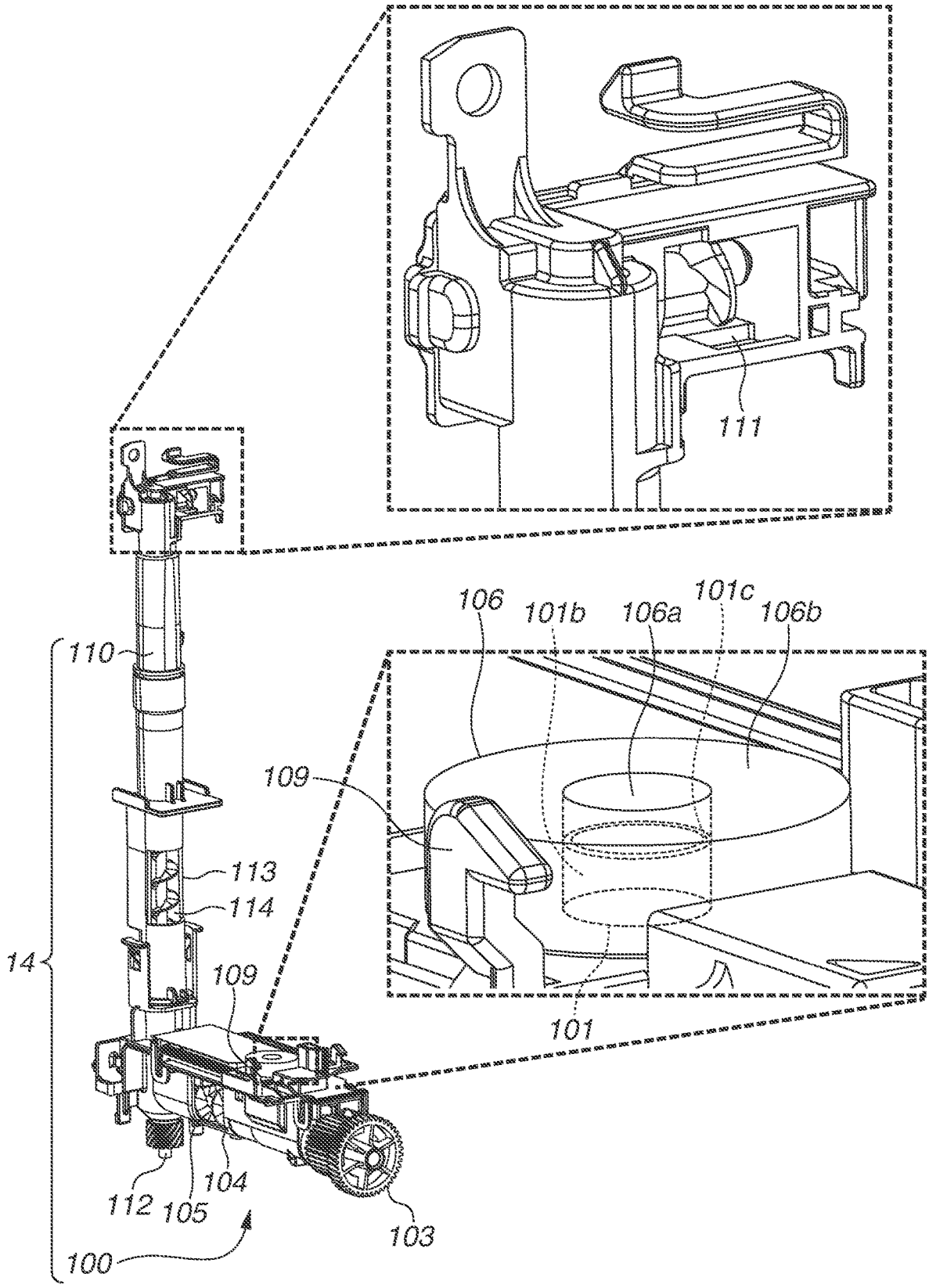
FIG. 1 is a perspective view and partial enlarged views of a toner conveyance apparatus according to a first exemplary embodiment.
Figure 2:
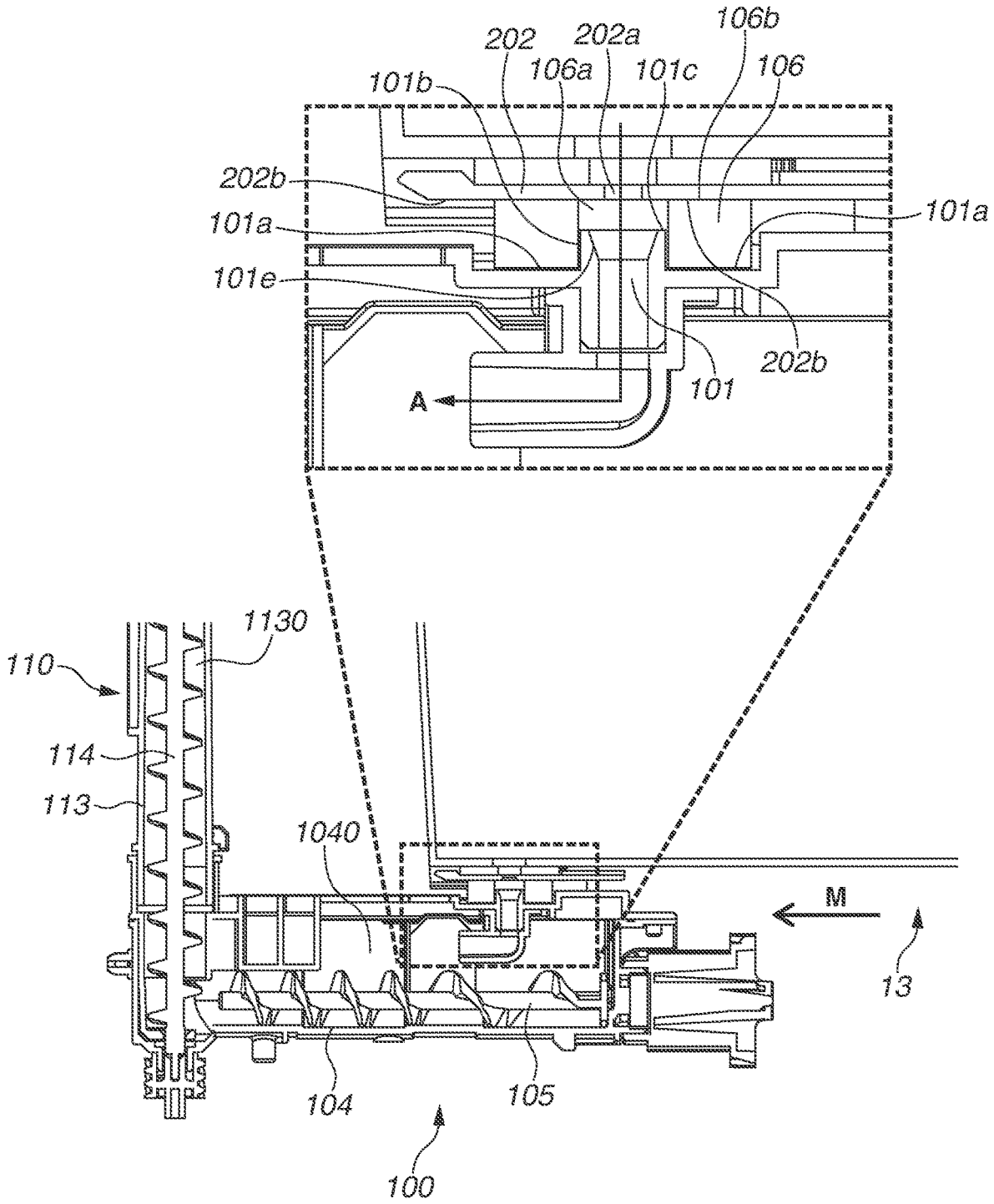
FIG. 2 is a cross-sectional view of an upstream conveyance unit of the toner conveyance apparatus according to the first exemplary embodiment.

The toner conveyance apparatuses (the toner storage apparatuses) 14 according to the present exemplary embodiment will be described with reference to FIGS. 1 and 2. FIG. 1 is an overall perspective view and partial enlarged views of each of the toner conveyance apparatuses 14. In FIG. 1, parts of an outer wall of the toner conveyance apparatus 14 are cut away to illustrate an internal configuration of the toner conveyance apparatus 14. FIG. 2 is a cross-sectional view of an upstream conveyance unit 100 of the toner conveyance apparatus 14.

As illustrated in FIG. 1, each of the toner conveyance apparatuses 14 includes the upstream conveyance unit 100 and a downstream conveyance unit 110. As illustrated in FIG. 2, the upstream conveyance unit 100 is provided with a first toner conveyance path (a toner storage frame) 1040 surrounded by a wall portion 104. On an upper surface of the wall portion 104, a reception port 101 is provided. The reception port 101 is configured to receive toner supplied from the corresponding toner container 13 when the toner container 13 is moved in a mounting direction (a moving direction) M and mounted on the apparatus main body 1000.

The upstream conveyance unit 100 is also provided with a seal member (a seal portion) 106. The seal member 106 fills a gap between the vicinity of the reception port 101 and the toner container 13 to suppress toner leakage when the toner container 13 is mounted on the apparatus main body 1000. The seal member 106 according to the present exemplary embodiment is an open-cell polyurethane foam sealing material. The seal member 106 is provided with a communication hole 106*a* communicating with the reception port 101. The seal member 106 is attached to a seal attachment surface 101*a* of the wall portion 104 with double-sided tape. As illustrated in FIG. 1, the seal member 106 has a contact surface (a rubbing surface) 106*b* that comes into contact (rubbing contact) with a container shutter 202 of the toner container 13. The contact surface 106*b* of the seal member 106 extends in a direction along the mounting direction M in a state where the toner container 13 is not mounted on the apparatus main body 1000.

The toner supplied from the toner container 13 passes through the communication hole 106*a* of the seal member 106 and the reception port 101, and is stored in the first toner conveyance path 1040. The first toner conveyance path 1040 extends in the mounting direction M of the toner container 13. The toner stored in the first toner conveyance path 1040 is conveyed toward the downstream conveyance unit 110 by an upstream screw (a conveyance member) 105 provided in the first toner conveyance path 1040. The upstream screw 105 is rotationally driven by an upstream driving gear 103 and conveys the toner in the direction of the downstream conveyance unit 110. On the upper surface of the wall portion 104, an engagement portion 109 configured to engage with the toner container 13 is also provided. The engagement portion 109 protrudes upward from the upper surface of the wall portion 104.

The downstream conveyance unit 110 includes a second toner conveyance path 1130 surrounded by a wall portion 113. A downstream screw 114 is provided inside the second toner conveyance path 1130. The furthest upstream portion in a toner conveyance direction of the second toner conveyance path 1130 is connected to the furthest downstream portion of the first toner conveyance path 1040. The toner conveyed by the upstream screw 105 in the upstream conveyance unit 100 reaches the downstream conveyance unit 110 and is conveyed toward the developing device 9 of the corresponding process cartridge 6 by the downstream screw 114. The downstream screw 114 is rotationally driven by a downstream driving gear 112 and conveys the toner upward in the vertical direction. As illustrated in FIG. 1, the toner conveyed by the downstream screw 114 passes through a discharge port 111 and is supplied to the corresponding developing device 9 (see FIG. 6).

<Toner Container>

Figure 3A:
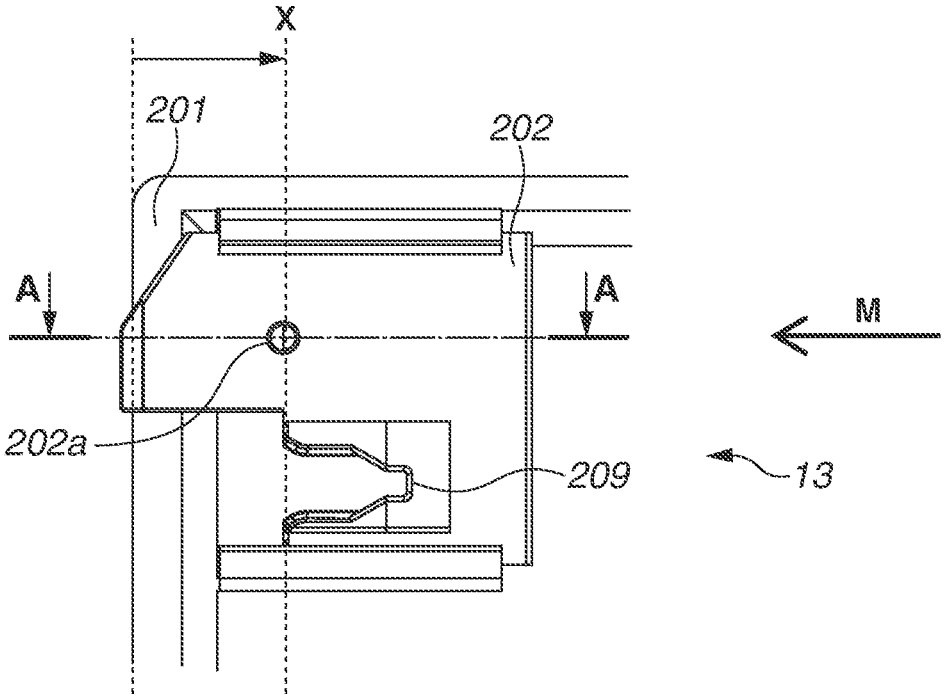
FIGS. 3A and 3B are a bottom view and a side view of a toner container according to the first exemplary embodiment in a state where a container shutter is at a closed position, respectively.
Figure 3B:
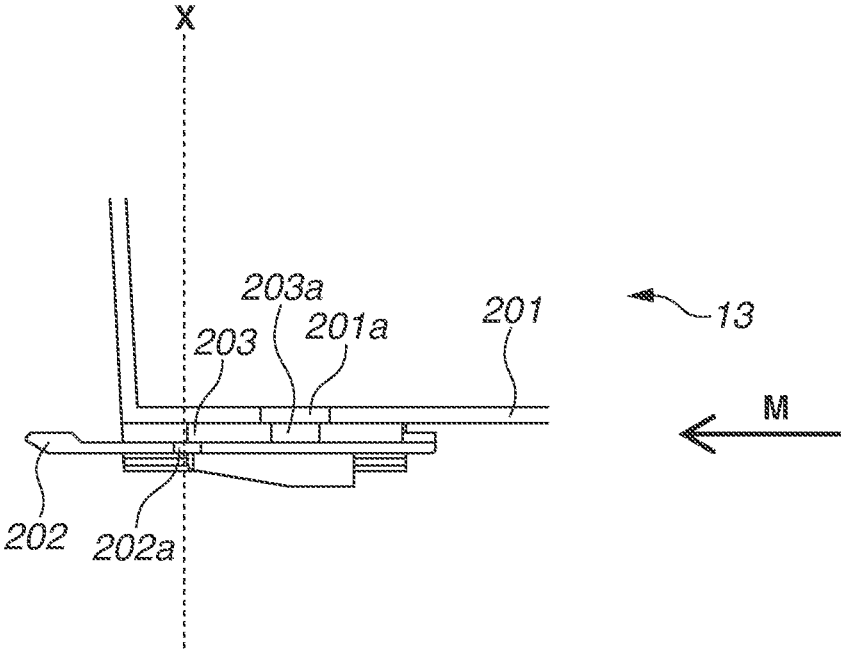
Figure 4A:
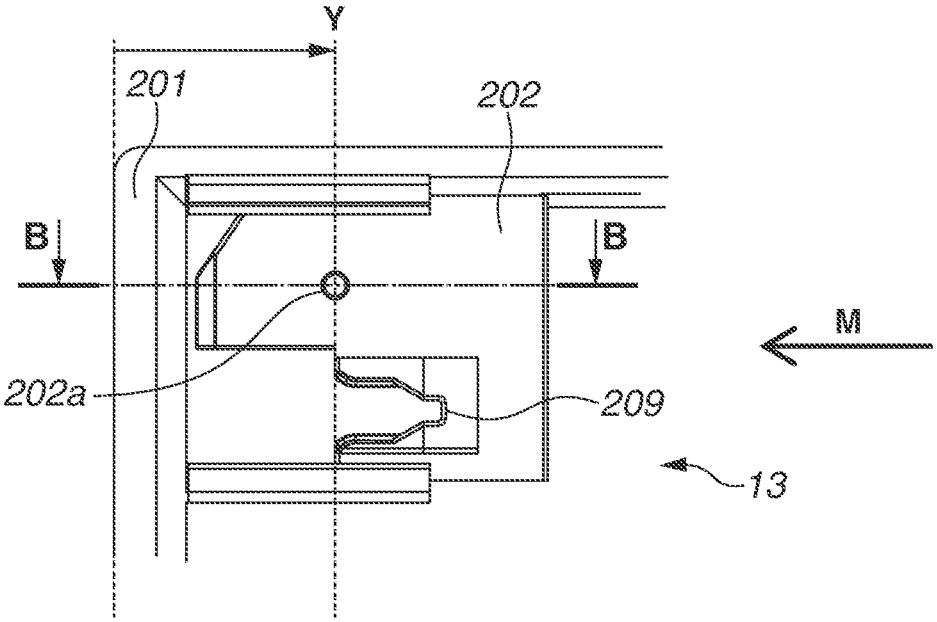
FIGS. 4A and 4B are a bottom view and a side view of the toner container according to the first exemplary embodiment in a state where the container shutter is at an open position, respectively.
Figure 4B:
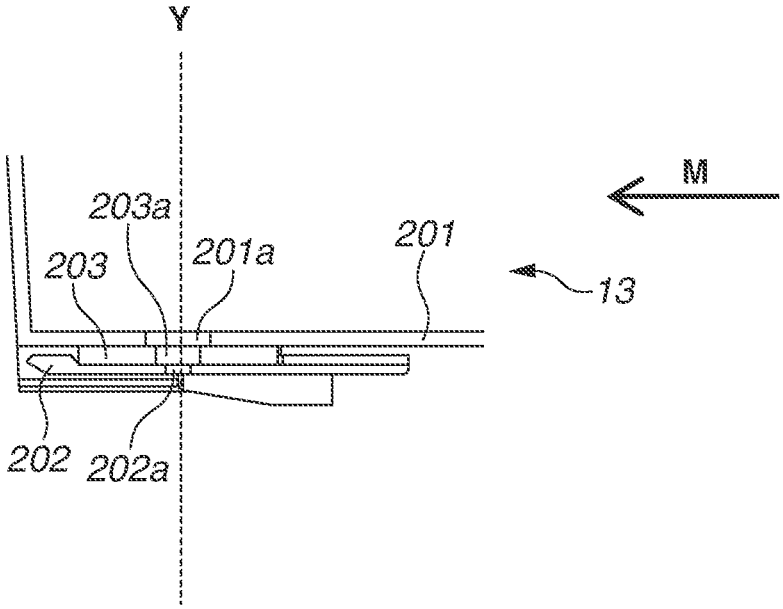

FIG. 3A is a bottom view illustrating each of the toner containers 13 viewed from below in a state where the toner container 13 is not mounted on the apparatus main body 1000 of the image forming apparatus 1. FIG. 3B is an A-A cross section in FIG. 3A. FIG. 4A is a bottom view illustrating each of the toner containers 13 viewed from below in a state where the toner container 13 is mounted on the apparatus main body 1000. FIG. 4B is a B-B cross section in FIG. 4A.

Each of the toner containers 13 includes a frame 201 and the container shutter 202. The frame 201 stores toner and is provided with a supply port 201*a*. The container shutter 202 is configured to move relative to the frame 201 between a closed position X (see FIGS. 3A and 3B) where the container shutter 202 closes the supply port 201*a* and an open position Y (see FIGS. 4A and 4B) where the container shutter 202 opens at least a part of the supply port 201*a*. The position of the container shutter 202 illustrated in FIGS. 3A and 3B is the closed position X, and the position of the container shutter 202 illustrated in FIGS. 4A and 4B is the open position Y. Each of the toner containers 13 further includes a container seal 203 that is provided with a container seal hole 203*a* communicating with the supply port 201*a* and is attached to the frame 201.

As illustrated in FIG. 3B, at the closed position X, the position of a shutter opening 202*a* of the container shutter 202 is shifted from the position where the supply port 201*a* of the frame 201 and the container seal hole 203*a* are located.

More specifically, the container shutter 202 closes the supply port 201*a* of the frame 201 and the container seal hole 203*a*, and the toner stored in the frame 201 is not discharged to the outside of the toner container 13.

As illustrated in FIGS. 3A and 4A, the container shutter 202 includes an engaged portion 209 configured to be engaged with the engagement portion 109 (see FIG. 1) of the toner conveyance apparatus 14 when the toner container 13 is mounted on the apparatus main body 1000. The engaged portion 209 is a recessed portion that is recessed in a direction opposite to the mounting direction M. If the toner container 13 is moved in the mounting direction M in a state where the container shutter 202 is at the closed position X illustrated in FIGS. 3A and 3B, the container shutter 202 is engaged with the engagement portion 109 of the toner conveyance apparatus 14 and is stopped. Since the frame 201 of the toner container 13 is moved in the mounting direction M relative to the stopped container shutter 202, the container shutter 202 moves from the closed position X to the open position Y relative to the frame 201 and enters the state of FIGS. 4A and 4B. While the container shutter 202 is at the open position Y, the shutter opening 202*a* of the container shutter 202 is at the position where the shutter opening 202*a* communicates with the supply port 201*a* of the frame 201 and the container seal hole 203*a* (see FIG. 4B). Thus, the toner in the frame 201 of the toner container 13 can be supplied to the corresponding toner conveyance apparatus 14 via the supply port 201*a*, the container seal hole 203*a*, and the shutter opening 202*a*.

<Seal Regulation Portion>

As illustrated in FIG. 2, the wall portion 104 of the first toner conveyance path 1040 is provided with a protruding portion (a seal regulation portion) 101*b* protruding upward from the seal attachment surface 101*a*. The protruding portion 101*b* is located inside the communication hole 106*a* of the seal member 106.

Figure 5:
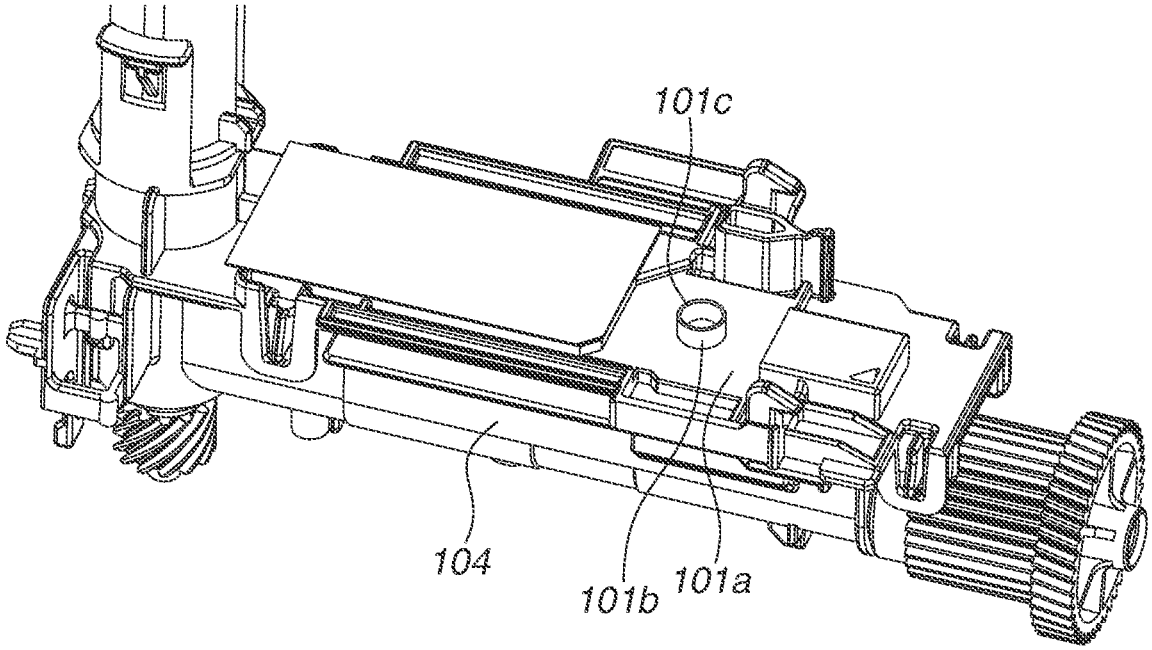
FIG. 5 is a perspective view of the toner conveyance apparatus according to the first exemplary embodiment in a state where a seal member is removed.

FIG. 5 is a perspective view of each of the toner conveyance apparatuses 14 in a state where the seal member 106 is removed to facilitate viewing of the protruding portion 101*b*. The protruding portion 101*b* according to the present exemplary embodiment is a cylindrical rib formed integrally with the wall portion 104.

In a state where the toner container 13 is not mounted on the apparatus main body 1000 (see FIG. 1), an end surface 101*c* of the protruding portion 101*b* is closer to the seal attachment surface 101*a* than the contact surface 106*b* of the seal member 106 with reference to a direction perpendicular to the seal attachment surface 101*a*. This configuration enables, when the toner container 13 is mounted on the apparatus main body 1000, the seal member 106 to be pushed by an outer surface 202*b* (see FIG. 2) of the container shutter 202 and compressed in the direction perpendicular to the seal attachment surface 101*a*. Furthermore, providing a tapered surface 101*e* (see FIG. 2) in an end portion of the protruding portion 101*b* makes toner less likely to be accumulated on the end surface 101*c*. The tapered surface 101*e* is inclined so as to approach the reception port 101 as the tapered surface 101*e* approaches the seal attachment surface 101*a* in the direction perpendicular to the seal attachment surface 101*a*.

When the toner container 13 is moved in the mounting direction M so that the toner container 13 is mounted on the apparatus main body 1000, the outer surface 202*b* of the container shutter 202 illustrated in FIG. 2 comes into rubbing contact with the contact surface 106*b* of the seal member 106 while pushing and compressing the contact surface 106*b* of the seal member 106. At this time, the contact surface 106*b* of the seal member 106 receives a frictional force from the container shutter 202 in the mounting direction M, and due to the frictional force, a part of the seal member 106 located upstream of the reception port 101 in the mounting direction M is likely to cause elastic deformation (shear deformation) in the mounting direction M (the direction toward the reception port 101).

The protruding portion 101*b* includes a portion that is located inside the communication hole 106*a* of the seal member 106 and upstream of the reception port 101 in the mounting direction M. Thus, the protruding portion 101*b* suppresses (regulates) the elastic deformation of the seal member 106 in the direction toward the reception port 101.

Furthermore, the protruding portion 101*b* according to the present exemplary embodiment is a cylindrical rib that is provided so as to surround the reception port 101, and an inner peripheral surface of the communication hole 106*a* of the seal member 106 opposes an outer peripheral surface of the protruding portion 101*b* with a minute gap, or is in contact with the outer peripheral surface. Accordingly, the protruding portion 101*b* also functions to position the seal member 106 relative to the seal attachment surface 101*a* in the direction in which the seal attachment surface 101*a* extends.

As described above, in the present exemplary embodiment, the protruding portion 101*b* can suppress the elastic deformation of the seal member 106 in the direction toward the reception port 101. This reduces the necessity to determine the size of the communication hole 106*a* of the seal member 106 considering the elastic deformation of the seal member 106. In other words, making the communication hole 106*a* of the seal member 106 smaller than the conventional size can suppress toner contamination.

Furthermore, the protruding portion 101*b* according to the present exemplary embodiment also functions as a positioning portion for the seal member 106 and thus can improve the accuracy of positioning the seal member 106 relative to the reception port 101.

In the present exemplary embodiment, the reception port 101 of the wall portion 104 of the first toner conveyance path 1040 is a circular hole having a diameter of 3.0 mm. The protruding portion 101*b* is a cylindrical rib having an inner diameter of 3.0 mm and an outer diameter of 5.0 mm. The communication hole 106*a* of the seal member 106 is a circular hole having a diameter of 5.3 mm.

The shape of the protruding portion 101*b* may not necessarily be cylindrical as long as the protruding portion 101*b* is located inside the communication hole 106*a* of the seal member 106 and provided in a region upstream of the reception port 101 in the mounting direction M.

The mounting direction M for mounting the toner containers 13 according to the present exemplary embodiment on the apparatus main body 1000 is the horizontal direction, but this is not restrictive. For example, the toner containers 13 may be mounted on the apparatus main body 1000 by a rotational movement, and the mounting direction M may be a predetermined rotational direction.

Figure 7:
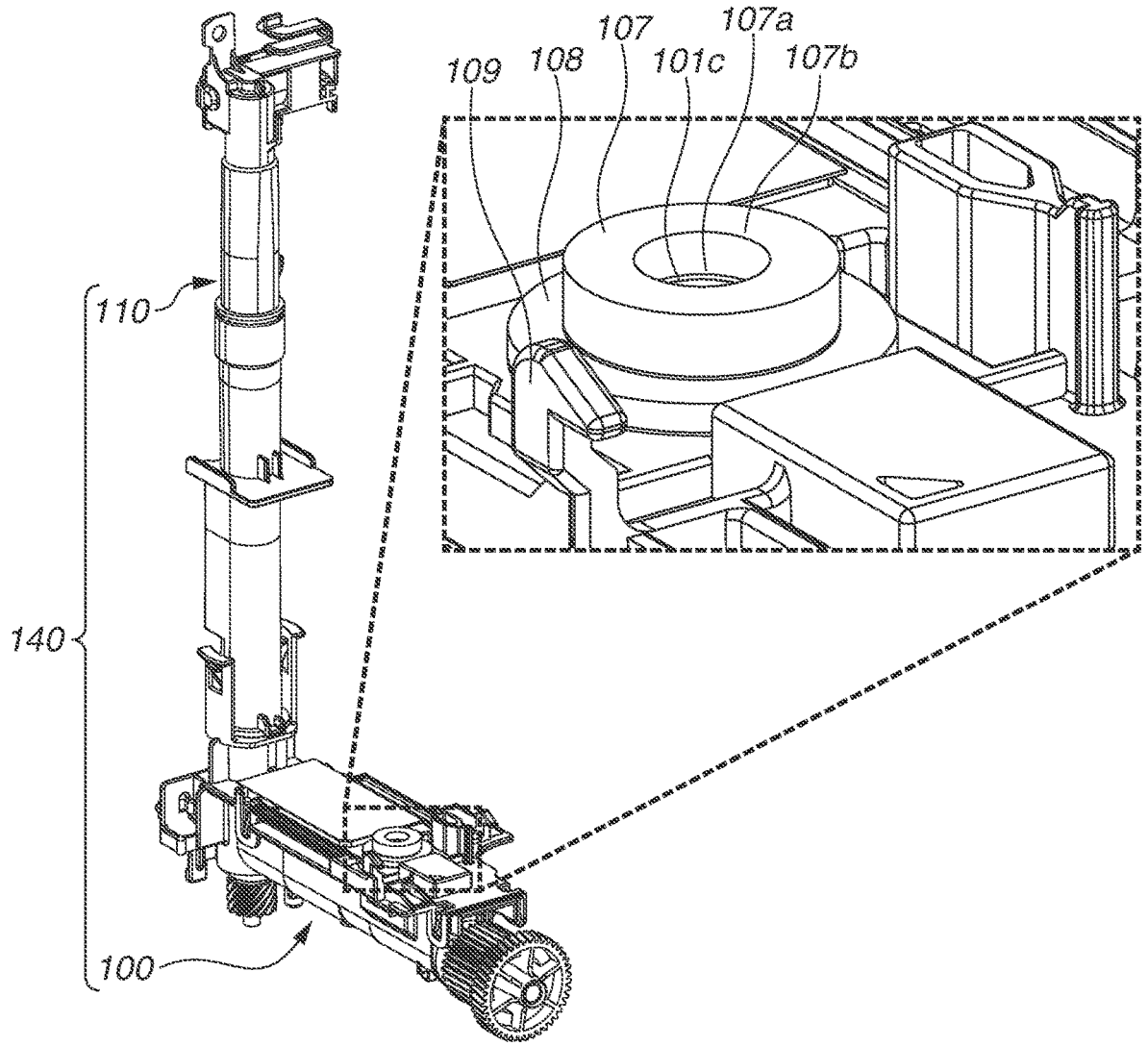
FIG. 7 is a perspective view and a partial enlarged view of a toner conveyance apparatus according to a second exemplary embodiment.
Figure 8:
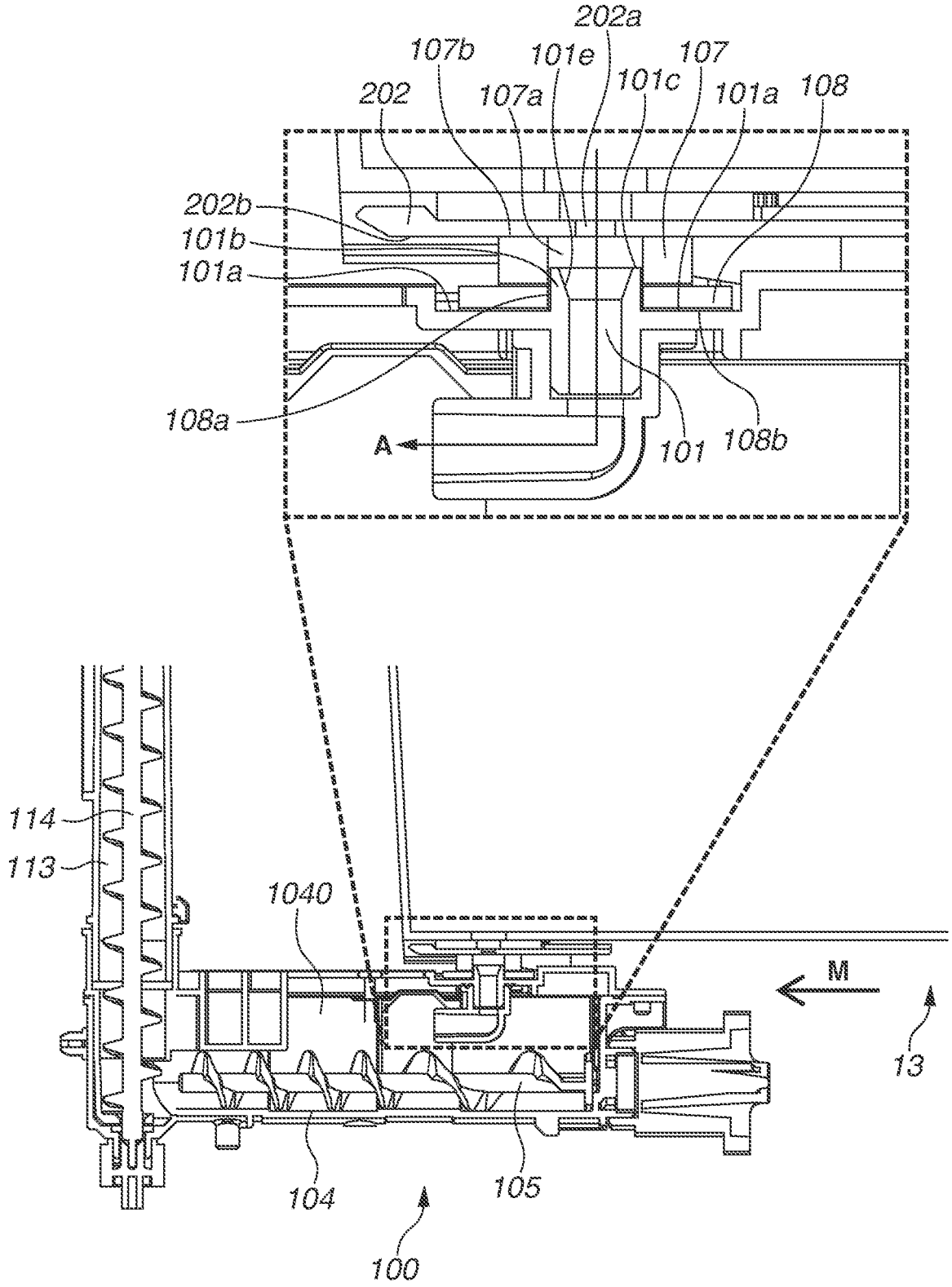
FIG. 8 is a cross-sectional view of an upstream conveyance unit of the toner conveyance apparatus according to the second exemplary embodiment.

A configuration according to a second exemplary embodiment of the present disclosure will be described next. FIG. 7 is a perspective view and a partial enlarged view of each of toner conveyance apparatuses 140 according to the present exemplary embodiment. FIG. 8 is a cross-sectional view of the upstream conveyance unit 100 of each of the toner conveyance apparatuses 140 according to the present exemplary embodiment. The toner conveyance apparatuses 140 according to the present exemplary embodiment are different from the toner conveyance apparatuses 14 according to the first exemplary embodiment in a structure of a seal portion provided in the wall portion 104 of the first toner conveyance path 1040. The other components are similar to those according to the first exemplary embodiment, and thus are denoted by the same reference numerals and will not be described.

The seal portion according to the present exemplary embodiment has a multi-layered seal structure including a first seal member 107 and a second seal member 108. The second seal member 108 is attached to the seal attachment surface 101*a* with double-sided tape, and the first seal member 107 is attached onto the second seal member 108. In other words, the first seal member 107 is provided above the second seal member 108 in the direction perpendicular to the seal attachment surface 101*a*. Thus, when the toner container 13 is moved in the mounting direction M, a contact surface 107*b* of the first seal member 107 comes into rubbing contact with the outer surface 202*b* of the container shutter 202. A surface 108*b* of the second seal member 108 is in contact with the seal attachment surface 101*a*.

The first seal member 107 and the second seal member 108 include a first communication hole 107*a* and a second communication hole 108*a*, respectively. Similarly to the first exemplary embodiment, the protruding portion 101*b* according to the present exemplary embodiment is a cylindrical rib. The first communication hole 107*a* and the second communication hole 108*a* both communicate with the reception port 101, and inner peripheral surfaces of the first communication hole 107*a* and the second communication hole 108*a* both oppose the outer peripheral surface of the protruding portion 101*b* with a minute gap or are in contact with the outer peripheral surface. With this configuration, similarly to the first exemplary embodiment, the protruding portion 101*b* suppresses a part of the first seal member 107 located upstream of the reception port 101 in the mounting direction M from elastically deforming in the direction toward the reception port 101. In addition, the protruding portion 101*b* positions the first seal member 107 and the second seal member 108 relative to the seal attachment surface 101*a* in the direction in which the seal attachment surface 101*a* extends. Furthermore, the relative position of the first seal member 107 and the second seal member 108 is less likely to be shifted.

In a state where the toner container 13 is not mounted on the apparatus main body 1000 (see FIG. 7), the end surface 101*c* of the protruding portion 101*b* is closer to the seal attachment surface 101*a* than the contact surface 107*b* of the first seal member 107 with reference to the direction perpendicular to the seal attachment surface 101*a*.

This configuration enables, when the toner container 13 is mounted on the apparatus main body 1000, the first seal member 107 and the second seal member 108 to be pushed by the outer surface 202*b* of the container shutter 202 and compressed in the direction perpendicular to the seal attachment surface 101*a*.

Next, differences in configuration between the first seal member 107 and the second seal member 108 will be described.

The first seal member 107 is configured so that, when compressed by a predetermined amount, the first seal member 107 has a compression pressure (a repulsive force) greater than that of the second seal member 108. In the present exemplary embodiment, the compression pressure of the second seal member 108 is 2 to 4 kPa when the compressibility of the second seal member 108 is 25%, whereas the compression pressure of the first seal member 107 is 29 to 59 kPa when the compressibility of the first seal member 107 is 25%. The first seal member 107 is closed-cell foam of which the main component is chloroprene rubber. The second seal member 108 is an open-cell polyurethane foam sealing material that is similar to the seal member 106 according to the first exemplary embodiment.

The first seal member 107, which comes into rubbing contact with the outer surface 202*b* of the container shutter 202, is made of a material having a relatively large repulsive force, whereby the elastic deformation of the first seal member 107 in the direction toward the reception port 101 is suppressed. On the other hand, the second seal member

108 is made of a material having a relatively small repulsive force so that the entire seal portion having a multi-layered structure is likely to be compressed in the direction perpendicular to the seal attachment surface 101*a*, whereby the sealing performance is ensured.

The area of the contact surface 107*b* of the first seal member 107 is smaller than the area of the surface 108*b* of the second seal member 108 that is in contact with the seal attachment surface 101*a*. This is intended to increase the adhesion of the second seal member 108 to the seal attachment surface 101*a* and also reduce the frictional force received by the contact surface 107*b* of the first seal member 107 from the outer surface 202*b* of the container shutter 202. This further suppresses the elastic deformation of the first seal member 107.

The thickness of the first seal member 107 is greater than the thickness of the second seal member 108 in the direction perpendicular to the seal attachment surface 101*a*.

As described above, the seal portion according to the present exemplary embodiment has a multi-layered seal structure including the first seal member 107 and the second seal member 108, whereby it is possible to further suppress the elastic deformation of the seal portion.

Figure 9:
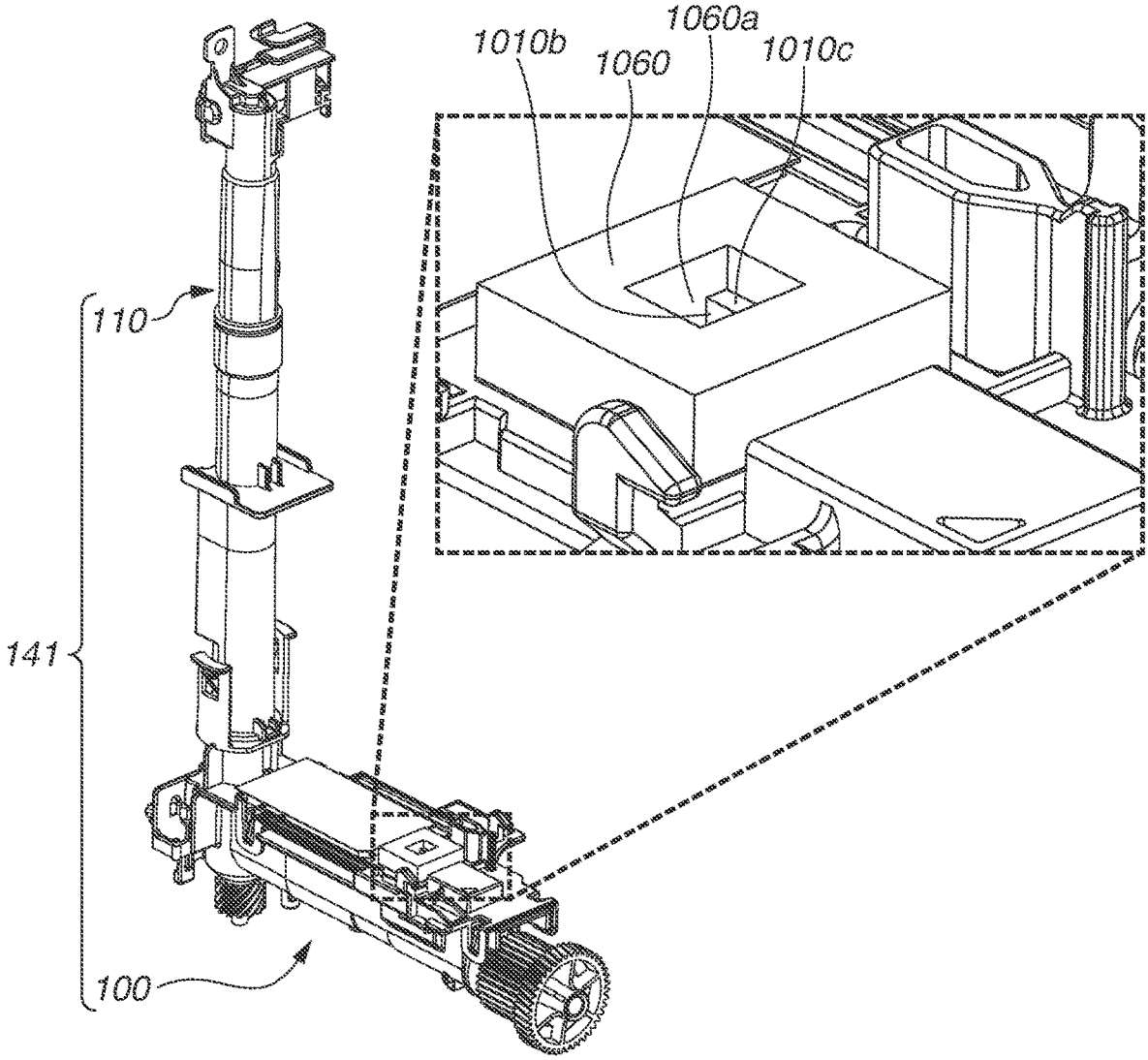
FIG. 9 is a perspective view and a partial enlarged view of a toner conveyance apparatus according to a third exemplary embodiment.
Figure 10:
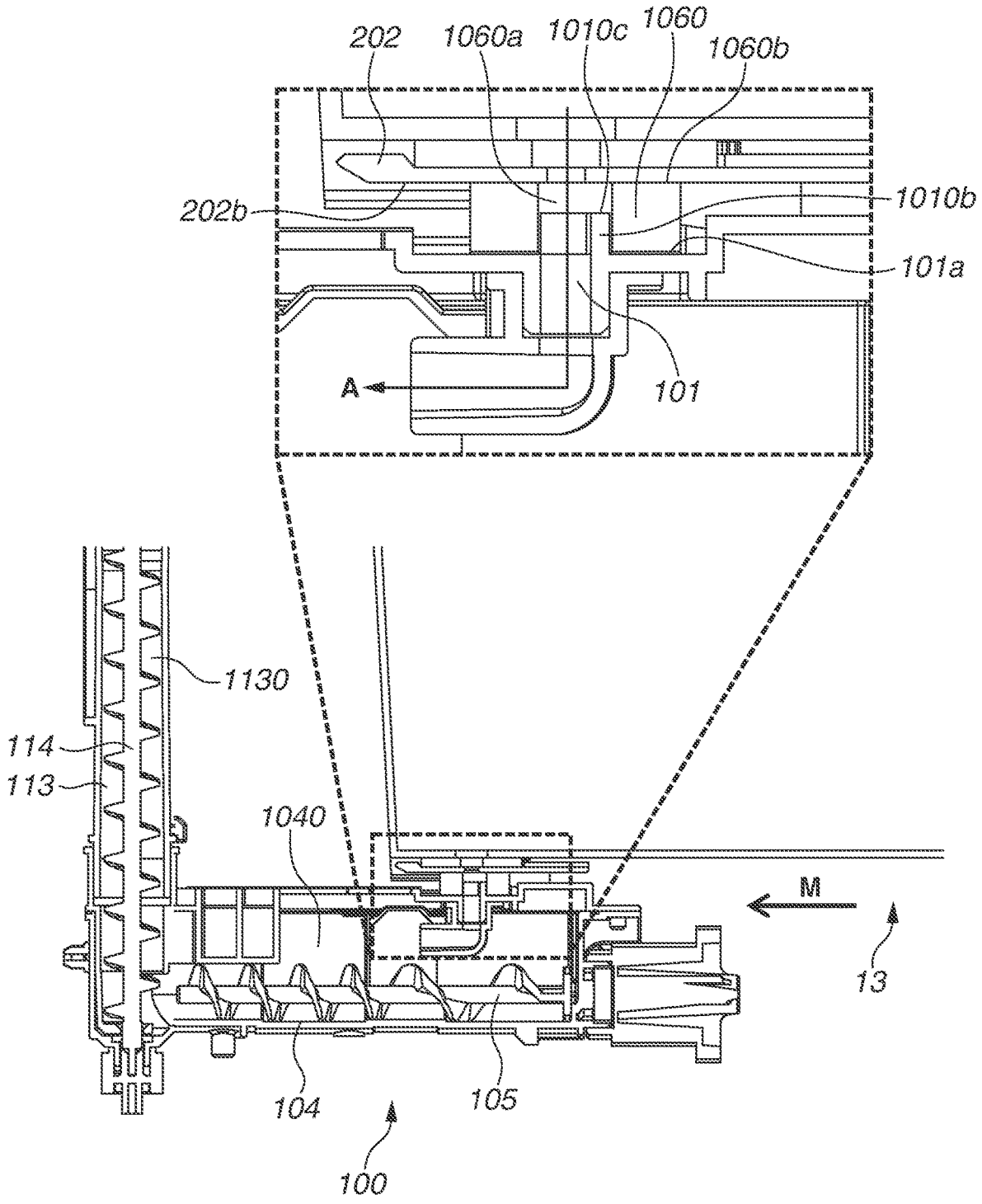
FIG. 10 is a cross-sectional view of an upstream conveyance unit of the toner conveyance apparatus according to the third exemplary embodiment.
Figure 11:
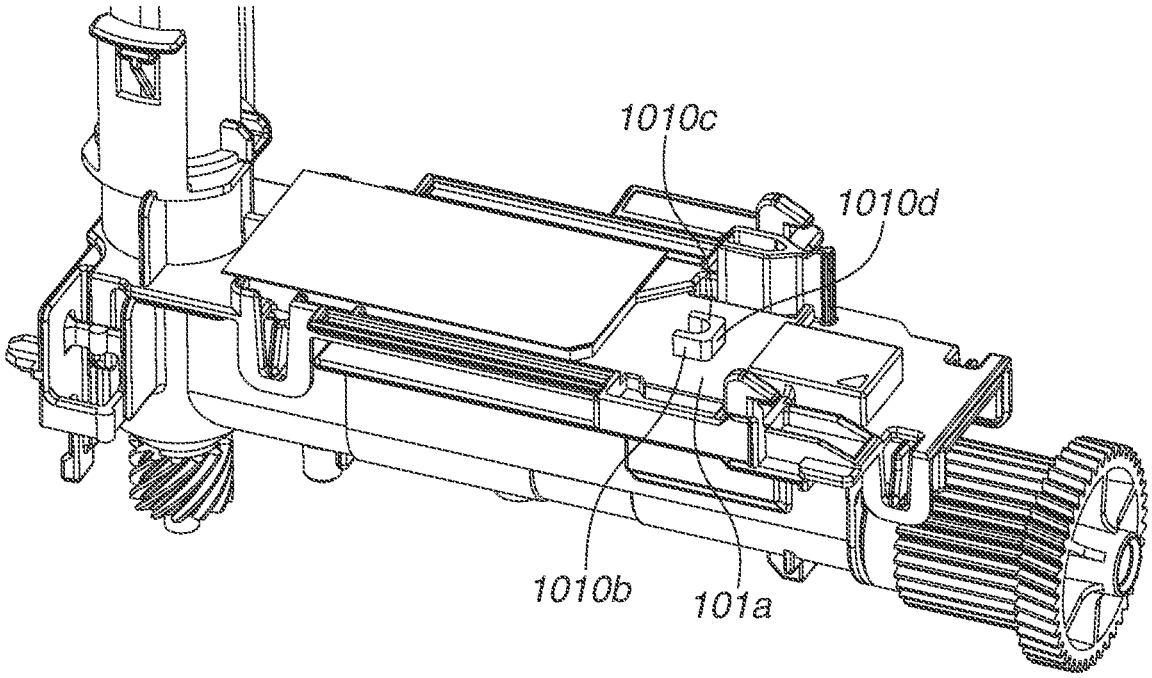
FIG. 11 is a perspective view of the toner conveyance apparatus according to the third exemplary embodiment in a state where a seal member is removed.

A third exemplary embodiment of the present disclosure will be described. FIG. 9 is a perspective view and a partial enlarged view of each of toner conveyance apparatuses 141 according to the present exemplary embodiment. FIG. 10 is a cross-sectional view of each of the toner conveyance apparatuses 141 according to the present exemplary embodiment. FIG. 11 is a perspective view of each of the toner conveyance apparatuses 141 in a state where a seal member 1060 is removed to facilitate viewing of a protruding portion 1010*b*. The toner conveyance apparatuses 141 according to the present exemplary embodiment are different from the toner conveyance apparatuses 14 according to the first exemplary embodiment in a shape of the protruding portion 1010*b* provided in the wall portion 104 of the first toner conveyance path 1040. The other components are similar to those according to the first exemplary embodiment, and thus are denoted by the same reference numerals and will not be described.

As illustrated in FIG. 9, the seal member 1060 according to the present exemplary embodiment has a rectangular shape when viewed from the direction perpendicular to the seal attachment surface 101*a*. The seal member 1060 has a communication hole 1060*a* communicating with the reception port 101 provided in the wall portion 104 of the first toner conveyance path 1040. The communication hole 1060*a* is a rectangular hole when viewed from the direction perpendicular to the seal attachment surface 101*a*.

As illustrated in FIG. 11, the protruding portion 1010*b* according to the present exemplary embodiment is a U-shaped rib when viewed from the direction perpendicular to the seal attachment surface 101*a*. A U-shaped opening is directed downstream in the mounting direction M. The protruding portion 1010*b* has a regulation surface 1010*d* in a region that is inside the communication hole 1060*a* of the seal member 1060 and is upstream of the reception port 101 in the mounting direction M, and thus can suppress the elastic deformation of the seal member 1060 in the direction toward the reception port 101. The regulation surface 1010*d* is a flat surface extending in a direction intersecting (orthogonal to) the mounting direction M, thereby facilitating the backup of the seal member 1060.

As described above, the present exemplary embodiment can provide a configuration capable of easily suppressing the elastic deformation of the seal member 1060 in the direction toward the reception port 101 by using the protruding portion 1010*b*.

The configurations according to the first to third exemplary embodiments can be applied to any configuration in which a first apparatus is detachably mounted on a second apparatus or is movable relative to the second apparatus, and the second apparatus receives toner supplied from the first apparatus. For example, the configurations according to the first to third exemplary embodiments can also be applied to a configuration in which toner is supplied directly from a toner container to a process cartridge. In the case of this configuration, a protruding portion is provided near a reception port of the process cartridge.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-017509, filed Feb. 5, 2021, which is hereby incorporated by reference herein in its entirety.

What is claimed is:

1. A toner storage apparatus to which a toner cartridge is mountable by being moved in a moving direction, the toner cartridge being provided with a supply port for supplying the toner, the toner storage apparatus comprising:

a toner storage frame provided with a reception port and a seal attachment surface, the toner storage frame being configured to store the toner supplied from the supply port of the toner cartridge through the reception port, the toner storage frame having a protruding portion protruding from the seal attachment surface; and a seal portion attached to the seal attachment surface of the toner storage frame, the seal portion having a rubbing surface configured to come into rubbing contact with the toner cartridge when the toner cartridge is moved in the moving direction, the seal portion being provided with a communication hole communicating with the reception port of the toner storage frame, wherein at least a part of the protruding portion is disposed inside the communication hole of the seal portion and upstream of the reception port of the toner storage frame in the moving direction, wherein a tip of the protruding portion is located closer to the seal attachment surface than the rubbing surface in a direction perpendicular to the seal attachment surface in a state where the toner cartridge is not mounted to the toner storage apparatus, and wherein the seal portion is in contact with an outer peripheral surface of the protruding portion that extends toward the communication hole of the seal portion.

2. The toner storage apparatus according to claim 1, wherein the protruding portion has a cylindrical shape that is formed so as to surround the reception port, and wherein the seal portion is provided so as to surround an entire circumference of the outer peripheral surface of the protruding portion.

3. The toner storage apparatus according to claim 2, wherein the reception port is a circular hole, and the protruding portion has a circular hole continuous with the reception port.

4. The toner storage apparatus according to claim 1, wherein the seal portion includes a first seal member having the rubbing surface, and a second seal member that is provided between the first seal member and the seal attachment surface in the direction perpendicular to the seal attachment surface and is in contact with the seal attachment surface, and wherein a compression pressure of the first seal member compressed by a predetermined amount is greater than a compression pressure of the second seal member compressed by the predetermined amount.

5. The toner storage apparatus according to claim 4, wherein an area of the rubbing surface of the first seal member is smaller than an area of a surface of the second seal member that is in contact with the seal attachment surface.

6. The toner storage apparatus according to claim 4, wherein a thickness of the first seal member is greater than a thickness of the second seal member in the direction perpendicular to the seal attachment surface in the state where the toner cartridge is not mounted to the toner storage apparatus.

7. The toner storage apparatus according to claim 1, further comprising a conveyance member configured to convey the toner stored in the toner storage frame.

8. The toner storage apparatus according to claim 1, wherein the rubbing surface of the seal portion extends in a direction along the moving direction of the toner cartridge in the state where the toner cartridge is not mounted to the toner storage apparatus.

9. The toner storage apparatus according to claim 1, wherein a tapered surface is provided in a tip end portion of the protruding portion, the tapered surface being inclined so as to approach the reception port as the tapered surface approaches the seal attachment surface in the direction perpendicular to the seal attachment surface.

10. An image forming apparatus, comprising:

a toner cartridge; and a toner storage portion for storing toner and to which the toner cartridge is mountable by being moved in a moving direction, the toner cartridge being provided with a supply port for supplying the toner, the toner storage portion including:

a toner storage frame provided with a reception port and a seal attachment surface, the toner storage frame being configured to store the toner supplied from the supply port of the toner cartridge through the reception port, the toner storage frame having a protruding portion protruding upward with respect to the seal attachment surface; and a seal portion attached to the seal attachment surface of the toner storage frame, the seal portion having a rubbing surface which extends in a direction along the moving direction of the toner cartridge and which is configured to come into rubbing contact with the toner cartridge when the toner cartridge is moved in the moving direction, the seal portion being provided with a communication hole communicating with the reception port of the toner storage frame, wherein at least a part of the protruding portion is disposed inside the communication hole of the seal portion and upstream of the reception port of the toner storage frame in the moving direction, wherein a tip of the protruding portion is located below the rubbing surface of the seal portion in a state where the toner cartridge is not mounted to the toner storage portion, and wherein the seal portion is in contact with an outer peripheral surface of the protruding portion that extends upward.

11. The image forming apparatus according to claim 10, wherein the protruding portion has a cylindrical shape that is formed so as to surround the reception port, and wherein the seal portion is provided so as to surround an entire circumference of the outer peripheral surface of the protruding portion.

12. The image forming apparatus according to claim 11, wherein the reception port is a circular hole, and the protruding portion has a circular hole continuous with the reception port.

13. The image forming apparatus according to claim 10, wherein the seal portion includes (i) a first seal member having the rubbing surface and (ii) a second seal member (ii-i) that is provided between the first seal member and the seal attachment surface in the direction perpendicular to the seal attachment surface and (ii-ii) that is in contact with the seal attachment surface, and wherein a compression pressure of the first seal member compressed by a predetermined amount is greater than a compression pressure of the second seal member compressed by the predetermined amount.

14. The image forming apparatus according to claim 13, wherein an area of the rubbing surface of the first seal member is smaller than an area of a surface of the second seal member that is in contact with the seal attachment surface.

15. The image forming apparatus according to claim 13, wherein a thickness of the first seal member is greater than a thickness of the second seal member in the direction perpendicular to the seal attachment surface in the state where the toner cartridge is not mounted to the toner storage portion.

16. The image forming apparatus according to claim 10, further comprising a conveyance member configured to convey the toner stored in the toner storage frame.

17. The image forming apparatus according to claim 10, wherein the rubbing surface of the seal portion extends in a direction along the moving direction of the toner cartridge in the state where the toner cartridge is not mounted to the toner storage portion.

18. The image forming apparatus according to claim 10, wherein a tapered surface is provided in a tip portion of the protruding portion, the tapered surface being inclined so as to approach the reception port as the tapered surface approaches the seal attachment surface in the direction perpendicular to the seal attachment surface.

* * * * *